US005832863A

United States Patent [19]

Sherlock

[11] Patent Number: 5,832,863

[45] Date of Patent: Nov. 10, 1998

[54] TRUE TRACK TRIM BLADES

[76] Inventor: John Sherlock, 4540 Lake Gentry Rd., St. Cloud, Fla. 34772

[21] Appl. No.: 867,936

[22] Filed: Jun. 3, 1997

[51] Int. Cl.[6] ..... B63B 1/22

[52] U.S. Cl. ..... 114/285; 114/286

[58] Field of Search ..... 114/284–287

[56] References Cited

U.S. PATENT DOCUMENTS

| | | | |
|---|---|---|---|
| 2,816,521 | 12/1957 | Alexander | 114/285 |
| 3,561,389 | 2/1971 | Hunt | 114/285 |
| 3,577,948 | 5/1971 | Frey | 114/286 |
| 3,602,178 | 8/1971 | White | 114/285 |
| 3,628,486 | 12/1971 | Bennett | 114/285 |
| 3,650,310 | 3/1972 | Childress | 114/286 |
| 3,698,343 | 10/1972 | Broome | 114/285 |
| 4,000,712 | 1/1977 | Erikson et al. | 114/284 |
| 4,323,027 | 4/1982 | Schermerhorn | 114/285 |
| 4,968,275 | 11/1990 | Carlson | 114/285 |

*Primary Examiner*—Ed L. Swinehart
*Attorney, Agent, or Firm*—Patent & Trademark Services; Joseph H. McGlynn

[57] ABSTRACT

A trim tab which is attached to the transom of a boat and which has a hydraulic ram which can adjust the angle that the trim tab assumes with respect to the surface of the water. In addition, the body of the tab is hydrodynamically shaped to provide very little drag.

5 Claims, 1 Drawing Sheet

TRUE TRACK TRIM BLADES

BACKGROUND OF THE INVENTION

This invention relates, in general, to a stabilizing device, and, in particular, to a stabilizing device for power boats to insure that the boat will operate on an even keel.

DESCRIPTION OF THE PRIOR ART

In the prior art various types of stabilizing devices have been proposed. For example, U.S. Pat. No. 2,816,521 discloses a power boat stabilizing device which consists of a pair of flat plates which are hinged to the back of the boat, and which has a locking mechanism which will hold the plates in various positions. U.S. Pat. No. 3,602,178 discloses a boat planing and brake apparatus having a fin connected to the transom of the boat and which can be swung from a horizontal planing position to an inclined braking position. U.S. Pat. No. 3,628,486 discloses a pair of trim tabs for a boat which are operable at slow speeds to lift the boat and which become inoperable at high speeds. U.S. Pat. No. 3,698,343 discloses a boat having a hull bottom shaped to form a longitudinal channel and a trim tab is positioned adjacent the channels. U.S. Pat. No. 4,323,027 discloses a trim tab having a mounting plate attached to the transom of a boat and a lifter which extends from the mounting plate at a right angle. The lifter has a trailing region curving down around a transverse axis aft of the mounting plate and below the lifter.

U.S. Pat. No. 4,968,275 discloses a stabilizer attached to the cavitation plate of a motor which consists of tubular members attached at a downward angle away from the boat.

SUMMARY OF THE INVENTION

The present invention comprises a trim tab which is attached to the transom of a boat and which has a hydraulic ram which can adjust the angle that the trim tab assumes with respect to the surface of the water. In addition, the body of the tab is hydrodynamically shaped to provide very little drag. The present invention will enable a boat to stay on track while traveling in a straight line and while engaged in turns.

It is an object of the present invention to provide a new and improved trim tab which will provide little drag.

It is an object of the present invention to provide a new and improved trim tab which will prevent the tab from altering the direction of the boat.

It is an object of the present invention to provide a new and improved trim tab which will improve the handling and safety for boats of many different types.

It is an object of the present invention to provide a new and improved trim tab which will lessen the chance of a boat changing ends or spinning out in a turn.

It is an object of the present invention to provide a new and improved trim tab which will enable the trim angle to be set easily.

It is an object of the present invention to provide a new and improved trim tab which will lessen the chance of a boat from tripping, i.e. when the bow of the boat enters the water.

It is an object of the present invention to provide a new and improved trim tab which will enable a boat to run with higher prop heights with less chance of prop walking and/or spinning out.

These and other objects and advantages of the present invention will be fully apparent from the following description, when taken in connection with the annexed drawings.

DESCRIPTION OF THE PREFERRED EMBODIMENT

Figure 1:
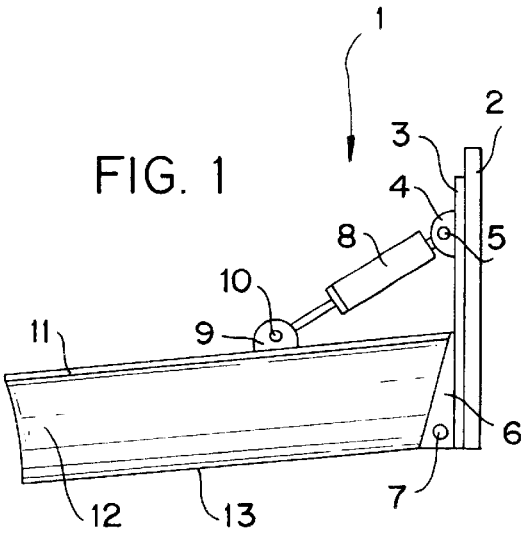
FIG. 1 is a side view of the present invention attached to a transom of a boat.

Referring now to the drawings in greater detail, FIG. 1 shows the invention 1 attached to the transom of a boat 2. Normally two trim tabs will be attached on opposite sides of the boat, however, since the tabs are identical only one trim tab will be described.

Each trim tab will be attached to a mounting plate 3 which will be attached to the transom 2 by any conventional means. The lower portion of the tab will be attached to the mounting plate by a gusset plate, attached to the mounting plate by any conventional means, and a pivot pin 7 which will pass through aligned apertures in the gusset plate and the trim tab. The pivot pin will allow the trim tab to pivot up and down in order to change the angle of the tab with respect to the surface of the water.

The upper portion 11 of the trim tab will be attached to the mounting plate 3 by a gusset plate 4, attached to the mounting plate 3 in the same manner as the gusset plate 6. A hydraulic ram 8 is attached at one end to the gusset plate 4 by a pivot pin 5. The other end of the ram 8 is attached to the top of the trim tab by a gusset plate 9 and a pivot pin 10.

The hydraulic ram is a conventional unit and the particular type of ram is not material to the present invention. The ram could be a manual operated mechanical ram or it could be electrically operated. If electrically operated, the ram would be connected to the boat's electrical system in any conventional fashion. Since the ram and its method of operation are conventional, they will not be described in further detail.

Figure 2:
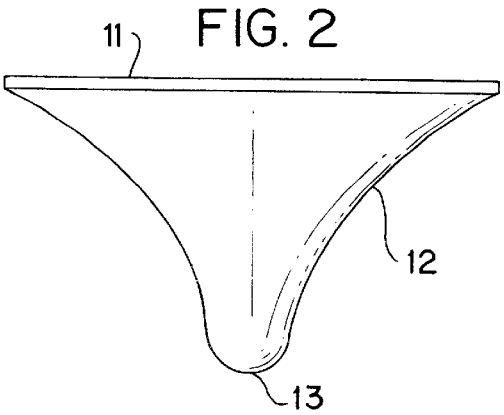
FIG. 2 is an end view of the present invention.

As can be seen in FIG. 2, the trim tab of the present invention has a substantially flat upper portion 11. Connected to this portion are sides 12 which taper to a reduced bottom portion 13. Due to the more efficient shape of the tabs there will less drag on the boat when the tabs engage the water surface which will allow the boat to travel faster or more efficiently through the water. This is a decided improvement over the conventional "flat" type of trim tabs which are common in the prior art, such as the tabs disclosed by Alexander (U.S. Pat. No. 2,816,521). The tabs of Alexander, because of the amount of surface area in contact with the water will increase the drag on the boat, thereby decreasing the efficiency of the boat. Also, with less surface area in contact with the water there will be less chance of "tripping" the boat which leads to the bow of the boat entering the water.

Figure 3:
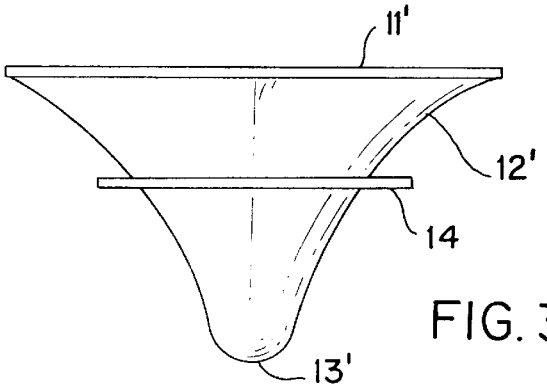
FIG. 3 is a view of another embodiment of the present invention with optional wing plates.

In FIG. 3, a modified form of the trim tab is shown. This embodiment has a top portion 11', sides 12' and a bottom 13'. A wing plate 14 is attached to the mid portion of the trim tab, by any conventional means, to allow more surface area to come in contact with the water. By allowing the user to use a trim tab with or without wing plates, the user can "tune" his/her boat so it will be as aggressive as the user desires.

Figure 4:
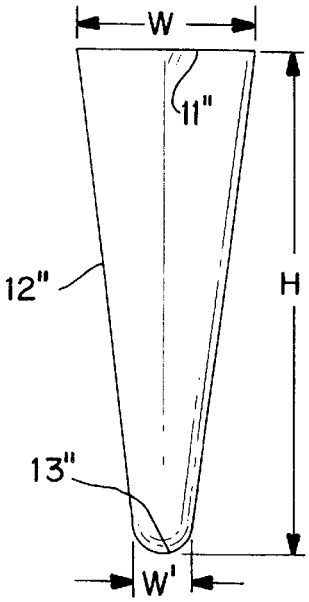
FIGS. 4–6 are end views of optional shapes of the present invention.
Figure 5:
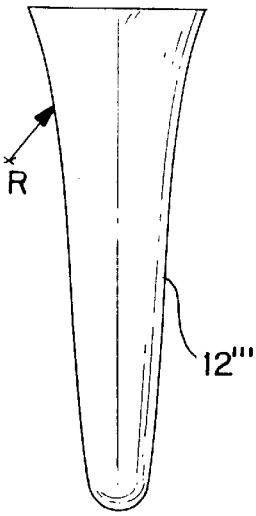
Figure 6:
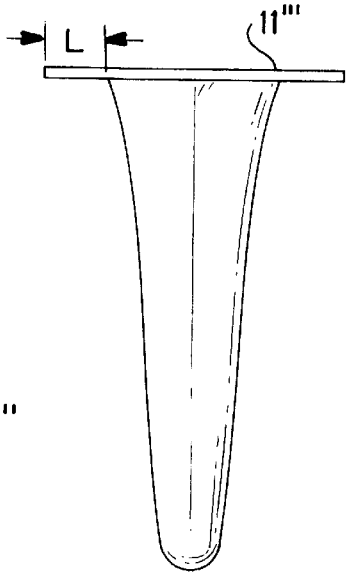

In addition, the shape of the trim tabs can be modified, as shown in FIGS. 4–6. The size of the width of top 11" (W), height (H) of the sides 12" and/or the width of bottom 13"

(W'), as seen in FIG. 4 can be varied to change the performance of the tab.

In addition, as seen in FIG. 5, the sides 12''' can have a radius of curvature R instead of straight sides as shown in FIG. 4, which can be varied to change the performance of the tab.

Another variation of the tab can be seen in FIG. 6 in which the top of the tab has an enlargement 11'''' which overhangs the top of the tab by a distance L. Again the distance L can be varied to change the performance of the tab.

In use a pair of trim tabs will be attached to either side of the transom of a boat. The angle of engagement of the trim tabs can be varied by raising or lowering the ram 8 which will assist their lifting of the stern of the boat to increase the maneuverability of the boat. In addition, the amount of the sides of the trim tabs within the water will inhibit lateral movement of water and consequently improves lift.

Although the True Track Trim Blades and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A trim tab stabilizing device adapted to be mounted adjacent the bottom of a transom of a boat, said device comprising:

means for mounting said trim tab stabilizing device to a boat, means for adjusting the position of said trim tab stabilizing device, said trim tab stabilizing device having a relatively flat top portion and a rounded bottom portion, said top portion being larger than said bottom portion, tapered side portions which connect said top portion with said bottom portion.

2. The trim tab stabilizing device as claimed in claim 1, wherein said side portions are concaved.

3. The trim tab stabilizing device as claimed in claim 1, wherein said side portions are straight.

4. The trim tab stabilizing device as claimed in claim 1, wherein a flat plate is attached to said trim tab stabilizing device between said top portion and said bottom portion.

5. A trim tab stabilizing device adapted to be mounted adjacent the bottom of a transom of a boat, said device comprising:

means for mounting said trim tab stabilizing device to a boat, means for adjusting the position of said trim tab stabilizing device, said trim tab stabilizing device having a relatively flat top portion and a rounded bottom portion, said top portion being larger than said bottom portion, tapered side portions which connect said top portion with said bottom portion, and wherein a flat plate is attached to said trim tab stabilizing device between said top portion and said bottom portion, said flat plate being positioned on a mid portion of said trim tab stabilizing device below said top portion and above said bottom portion.

* * * * *